United States Patent [19]

Sigott et al.

[11] 3,958,832

[45] May 25, 1976

[54] DRUM MINING HEAD WITH CUTTER PATTERN

[75] Inventors: Siegfried Sigott; Hubert Schwelberger, both of Zeltweg, Austria

[73] Assignee: Vereinigte Osterreichische Eisen- und Stahlwerke-Alpine Montan Aktiengesellschaft, Vienna, Austria

[22] Filed: Mar. 12, 1975

[21] Appl. No.: 557,881

Related U.S. Application Data

[63] Continuation of Ser. No. 374,384, June 28, 1973.

[30] Foreign Application Priority Data

June 30, 1972 Austria ..... 5635/72

[52] U.S. Cl. ..... 299/89; 175/91; 299/10

[51] Int. Cl.[2] ..... E21C 27/24

[58] Field of Search ..... 299/10, 18, 55, 56, 299/60, 85–89; 175/91, 377, 391

[56] References Cited

UNITED STATES PATENTS

| | | | |
|---|---|---|---|
| 720,841 | 2/1903 | Pawel | 299/89 X |
| 1,717,597 | 6/1929 | App | 299/10 |
| 1,723,381 | 8/1929 | Seifert | 175/391 X |
| 1,830,267 | 11/1931 | Ferris | 299/89 X |
| 3,064,958 | 11/1962 | Osgood | 299/85 |
| 3,516,712 | 6/1970 | Bennett et al. | 299/87 X |
| 3,774,969 | 11/1973 | Lebegue | 299/89 X |

*Primary Examiner*—Ernest R. Purser
*Attorney, Agent, or Firm*—Cushman, Darby & Cushman

[57] ABSTRACT

A tool body defines an axis of rotation for the tool and has a periphery surrounding said axis. A plurality of cutter bits are carried by said body and protrude substantially radially from said periphery and have free ends. Said cutter bits are arranged in a plurality of groups which are spaced in the direction of said axis. The free ends of the cutter bits of each of said groups define a circle. The circles defined by the free ends of the cutter bits of said groups increase in diameter in one direction along said axis.

4 Claims, 3 Drawing Figures

DRUM MINING HEAD WITH CUTTER PATTERN

BACKGROUND AND SUMMARY OF THE INVENTION

This is a continuation of application Ser. No. 374,384 filed June 28, 1973.

This invention relates to a rotary tool, particularly to a cutting tool for tunnel-driving machines. Such tunnel-driving machines may be ued for driving tunnels in coal, ore and rock; in this case the cutting tool detaches the material from the tunnel face. The usual practice hereby is to use the cutting tool for making substantially horizontally extending cuts in the tunnel face, which cuts extend one under the other. To be able to make these cuts, the cutting tool is rotatable and is pivotally movable at a constant feeding velocity in the direction of its axis of rotation, and has a body which is set at its periphery with substantially radially protruding cutter bits. Because the cutting tool is rotated and is pivotally moved at the same time, the cutter bits describe a helical path at their ends, where they are provided with cutting edges, so that the material is detached.

In the cutting tools known so far, the arrangement of the several cutter bits on the periphery of the cutting tool body was determined by experience in such a manner that all cutter bits were worn off as uniformly as possible. In a known cutting tool, e.g., the cutter bits are arranged on the cutting tool body along a spiral and only the rotary movement is taken into account in determining the position of the cutter bits whereas no consideration is given to the simultaneous pivotal movement. As a result, the sides of the cutter bits apply pressure to the rock so that the performance is much reduced. In spite of numerous attempts it has not been possible so far to provide a cutting tool which ensures a uniform wear of all cutter bits; in each case, some cutter bits were worn before the others and had to be replaced so that the tunnel-driving machine had to be stopped for the replacement of these cutter bits at a time when the other cutter bits were still satisfactory. As the stoppage of a tunnel-driving machine for a replacement of cutter bits involves a considerable loss of production, it is desired to ensure that the life of the cutter bits is as long as possible.

It is an object of the present invention to avoid the above-mentioned disadvantages and to provide a rotary tool, particularly a cutting tool for tunnel-driving machines, which tool ensures a uniform wear of all cutter bits. The invention resides essentially in that the cutter bits are arranged in a plurality of groups, which are arranged in succession in the direction of the axis of rotation, the cutter bits of each group are spaced around the periphery of the tool body, the ends of the cutter bits of the severl groups are disposed on circles which increase in diameter from group to group toward the support for the tool, and the cutting faces of the cutter bits are approximately normal to the direction of the resultant that is determined by the velocity of the revolving cutter bit ends and the feeding velocity of the tool. The design of a cutting tool according to the invention has the advantage that each cutter bit is subjected to the same specific cutting force so that a uniform loading of all cutter bits is ensured. In the use of the cutting tool according to the invention, grooves are first cut into the tunnel face by those cutter bits which belong to the group in which the ends of the cutter bits are disposed on the circle which is smallest in diameter and these grooves are increased in depth by the cutter bits whose ends are disposed on the next circle which is larger in diameter. These cutter bits are arranged to cut exactly in the grooves cut by the cutter bits of the first group. The cutter bits of each subsequent group thus increase the grooves in the tunnel face so that the narrow lands between these grooves finally break off. The cutting tool accoring to the invention thus enables a controlled cut by the cutting edges at the ends of all cutter bits so that an excellent cutting action is combined with a uniform wear of all cutter bits and the need for a premature replacing of individual cutter bits is eliminated. This results in long periods of operation between the times when the tunnel-driving machine must be stopped to replace the cutter bits.

In a desirable embodiment of the invention, the product of the width of the cutting face of each cutter bit of a group and of the number of cutter bits in the same group is as large as or smaller than the extent of the pivotal movement of the tool during one revolution thereof. With this design of the cutting tool, the grooves cut into the tunnel face by the cutter bits do not intersect but either directly adjoin or are separated by lands, which finally break off so that an optimum excavating performance is obtained with a minimum of power. The number of the cutter bits and the width of each cutter depends on the ratio of the width of the groove which is cut and the width of the land which has been left between two grooves and may be selected as desired in dependence on the hardness of the material to be removed, e.g., by the use of different cutting tools.

The difference between the diameters of the circles defined by the ends of the cutter bits or adjacent rows is suitably so large that each cutter bit during its cutting time increases the depth of the grooves in the tunnel face to such an extent that the cutter bits are subjected to a constant load and consequently to a constant wear.

An exemplary conventional mining machine with which the cutting tool according to the present invention is utilizable is shown on pages 44 and 49 of an article entitled "20 Jahre - Gewinnungs-Lademaschine, Bauart 'F'" by Dr. Z. Ajtay, published in *PUBLICATIONS OF THE HUNGARIAN MINING RESEARCH INSTITUTE* 1949–1969, No. 13, 1970.

It is the primary object of the present invention to provide an improved cutting tool for use in conventional mining machines. This and other objects of the invention will become clear from an inspection of the detailed description of the invention, and from the appended claims.

DETAILED DESCRIPTION OF THE INVENTION

Figure 1:
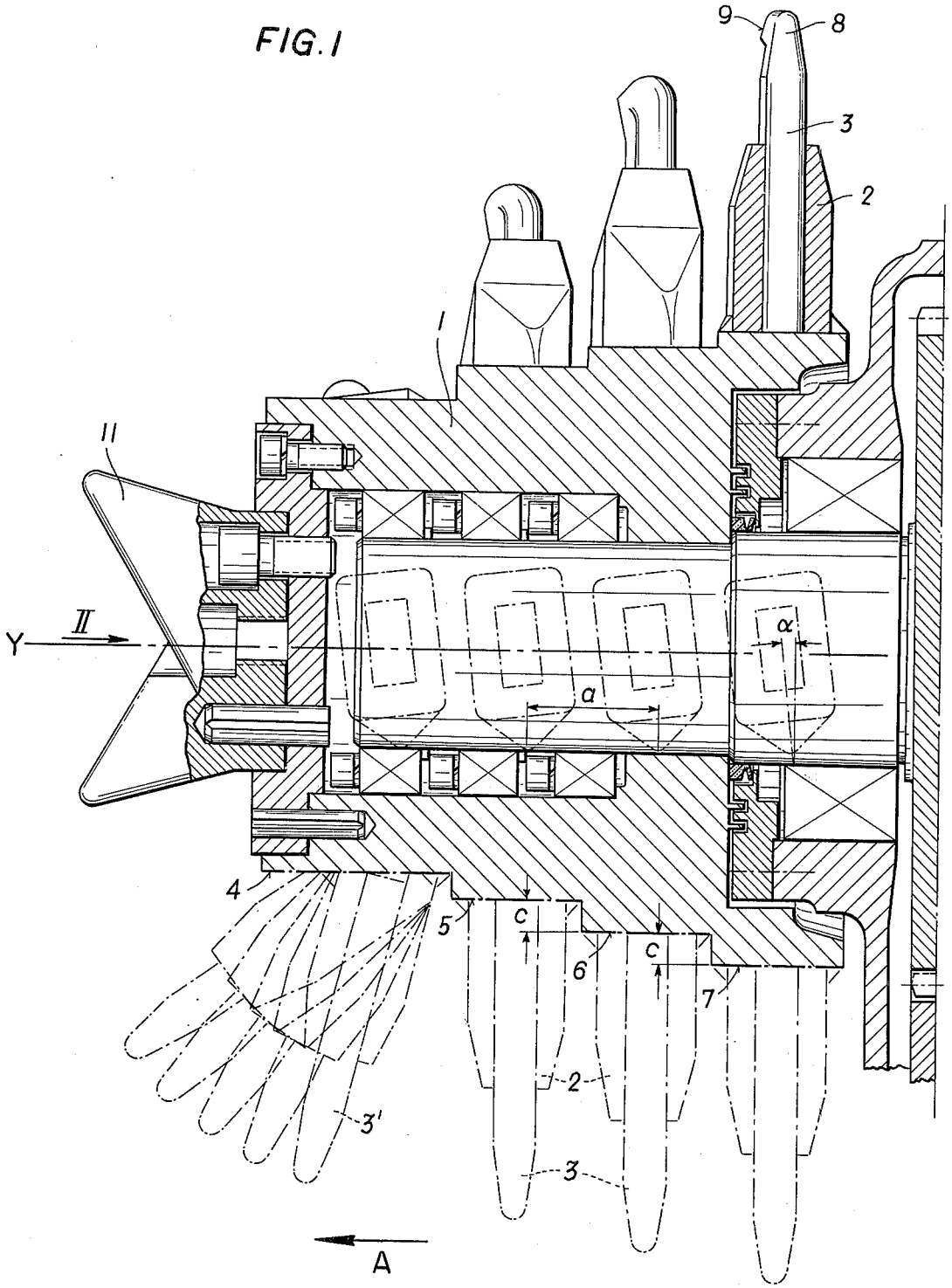
FIG. 1 is a sectional view taken along line I—I of FIG. 2 showing an exemplary cutting tool according to the present invention.

An exemplary cutting tool 15 according to the invention comprises a rotatably mounted body 1, which is carried by a jib arm. Each rotary mining head or cutting tool 15 is rotatable in a direction *r* about an axis of rotation Y. The jib arm (not shown) is pivotally movable about a king pin in a substantially horizontal direction and is adjustable in a vertical direction. The arrangement is such that a cutting tool 15 is provided on both sides of the jib arm. Depending on the direction of the pivotal movement, only one cutting tool 15 is used at the time. The jib arm carries also the cutting tool drive motor and a transmission. A conventional mining machine with which the cutting tool 15 according to the present invention may be utilized may be of the type shown on page 44 or page 49 of an article entitled "20 Jahre -Gewinnungs-Lademaschine, Bauart 'F'" by Dr. Z. Ajtay, published in *PUBLICATIONS OF THE HUNGARIAN MINING RESEARCH INSTITUTE* 1949–1969, No. 13, 1970. The mining machine itself forms/no part of the present invention.

The body 1 of cutting tool 15 is provided with cutter bit holders 2, which are welded to the body 1 and in which cutter bits 3 are held by suitable means, not shown.

As is apparent from FIG. 1, the body 1 is formed with steps 4, 5, 6 and 7 which differ in diameter and to which the cutter bit holders 2 are secured. As a result, the cutter bits 3 are arranged in a plurality of circular groups (41–45 in one group, 46–50 in another group, and 51–55 in a third group — see FIGS. 2 and 3), and are provided at their ends 8 with cutting edges which in the several groups lie on circles of differing diameters (Q, Q, S). As is apparent from FIG. 1, particularly from the dash-dot line representation thereof, the cutting edges 9 of the cutter bits are inclined in the direction of the resultant (R - see FIG. 3) which is due to the velocity ($V_r$) of the revolving cutter bit ends of each group and the velocity ($V_A$) in which the cutting tool is fed in the direction of the arrow A. Because the velocity at which the cutter bit ends revolve increases with the diameter for a given speed of the cutting tool and the feeding velocity of the cutting tool is constant, the cutting edges of the cutter bits whose ends define the circle which is smallest in diameter are inclined by the largest angle relative to an axis which is at right angles to the axis of rotation of the cutting tool and the cutting edges of the cutter bits whose cutting edges are disposed on the circle which is largest in diameter are inclined by the smallest angle $\alpha$ relative to an axis which is at right angles to the axis of rotation of the cutting tool.

The product of the width *a* of the cutter bits 3 in each group and the number of cutter bits in the same group is suitably smaller than the distance by which the cutting tool is pivotally moved at a constant velocity during one revolution thereof. As a result, lands are left between the grooves cut by the cutting edges of the cutter bits and these lands are broken out only as a result of the cutting adjacent thereto. In this way, an optimum excavating performance is achieved. The center distance *a* between the cutter bits of two adjacent groups, measured in the direction of the axis of the cutting tool, equals the product of the tangent of the angle of inclination $\alpha$ of a cutter bit whose end is disposed on the circle that is larger in diameter and the length of the arc $\gamma$ which is described by the end of said cutter bit over the angle $\beta$ by which said cutter bit lags behind that cutter bit which belongs to the preceding group and describes a path which is entered by the cutter bit of the succeeding group. Thus the relationship $a = \tan \alpha \cdot$ is fulfilled. As a result, the cutter bits of each group enter the groove formed by the cutter bits of the preceding group in the material to be excavated and increases the depth of said groove. In order to ensure that the cutter bits of all groups are subjected to the same wear, the difference between the diameters of two adjacent groups of cutter bits is so large that each cutter bit during its cutting time increases the grooves in the tunnel face to such an extent that the resulting load on the cutter bits ensures a uniform wear thereof.

The cutter bits of the group which is the first when viewed in the feeding direction A comprises cutter bits 3' which have different inclinations relative to the feeding direction A so that the desired profile can be neatly defined. Besides, a core breaker 11, known per se, is provided at the end face of the cutting tool.

Figure 2:
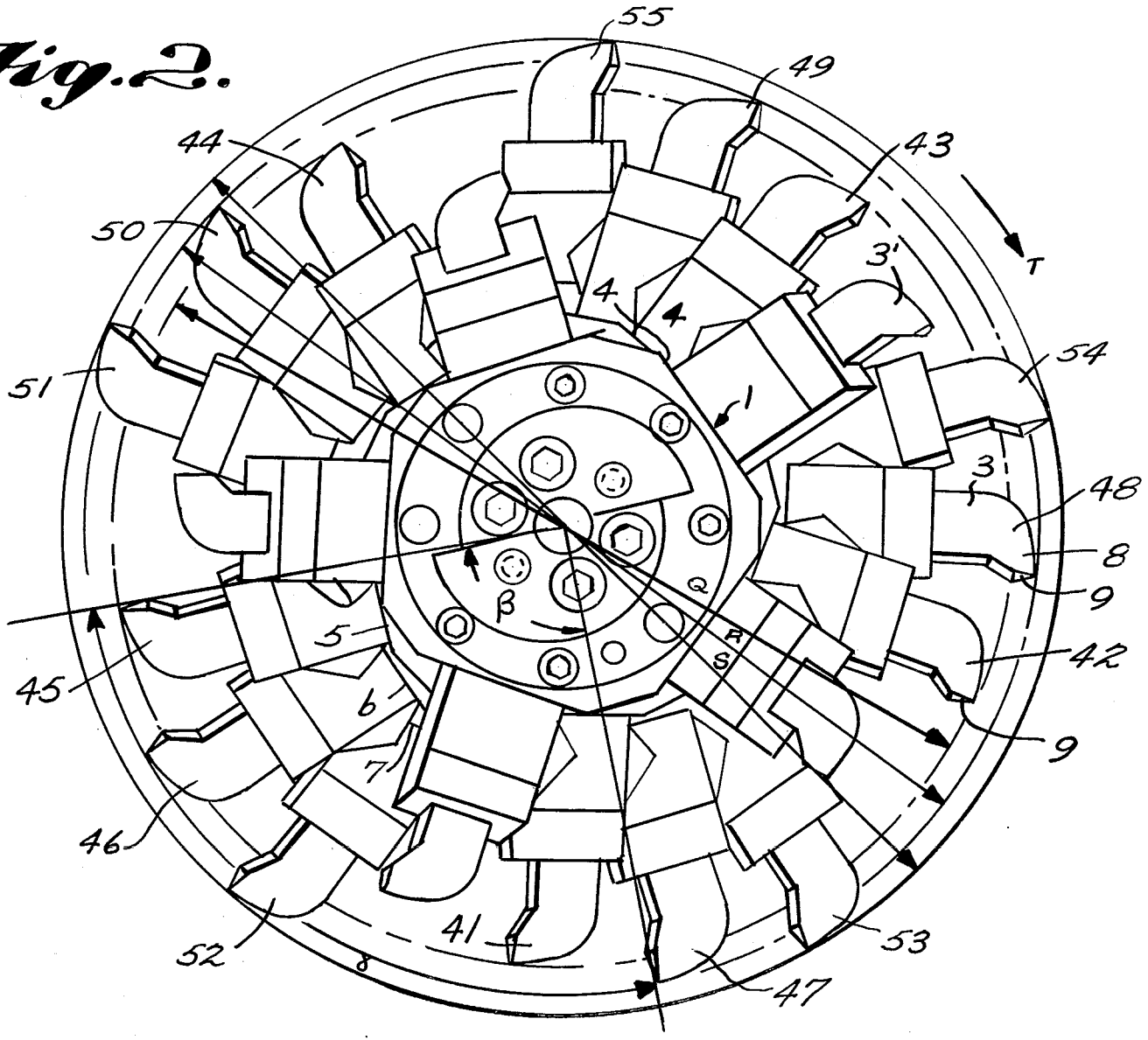
FIG. 2 is an elevational view taken in the direction of the arrow II in FIG. 1 showing the cutting tool of FIG. 1.
Figure 3:
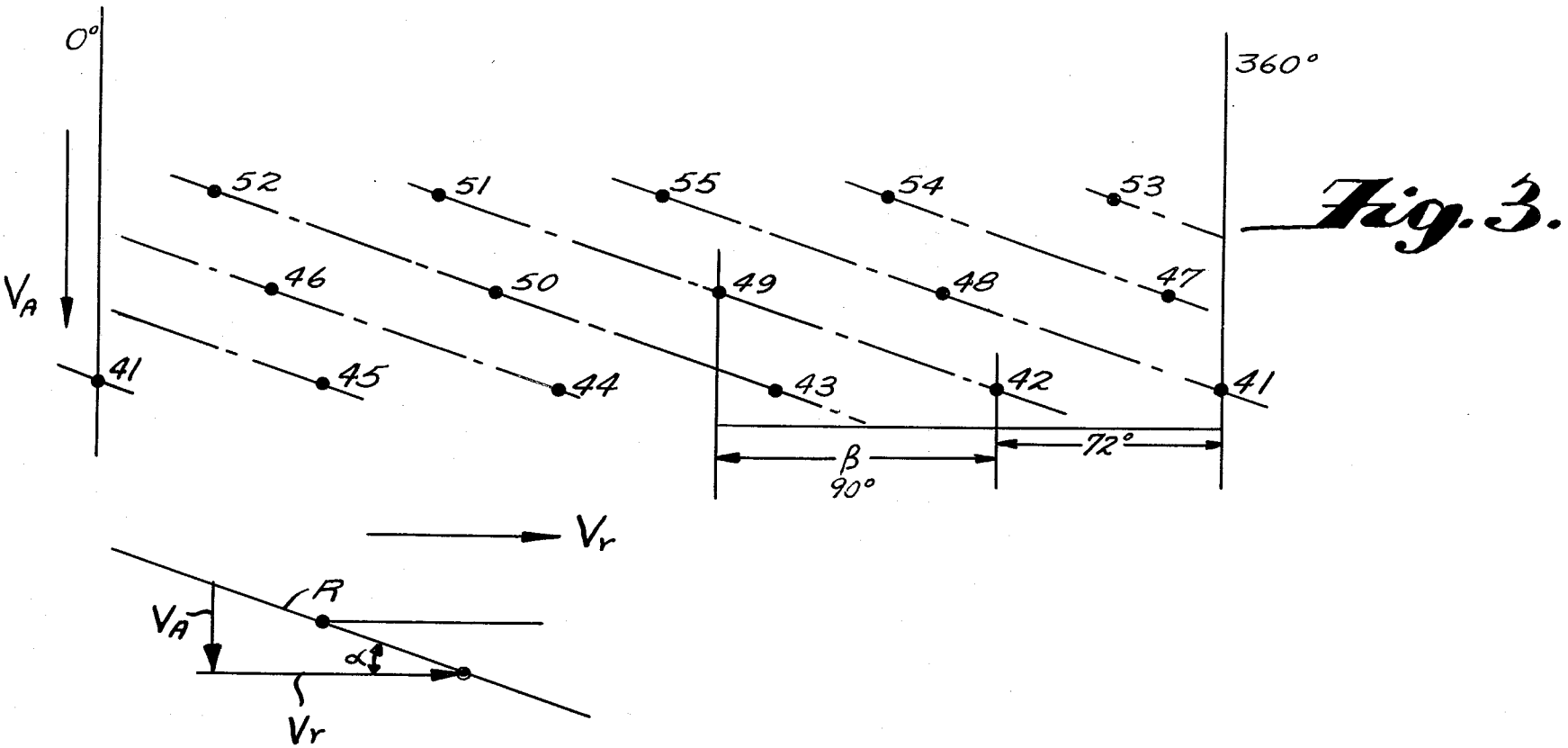
FIG. 3 is a graph tracing the paths of movement of cutting bits of the exemplary cutting tool according to the present invention shown in FIGS. 1 and 2.

The paths of movement of each of the cutter bits 3 of an exemplary cutting tool 15 according to the present invention, shown in FIG. 2, are charted in FIG 3. The cutter bits 3 are numbered 41-55 in FIG. 2, and their respective paths of movement are correspondingly numbered in FIG. 3. When the mining head rotates in the direction r, and at the same time the jib arm is swivelled in the direction A, cutter bits 3 of different length follow the same paths. For instance first the short cutter bit 41, then the longer cutter bit 48, and then the still longer cutter bit 55 cut the same groove deeper and deeper. According to one aspect of the present invention, the widths of the cutting faces 9 of the bits 3 are chosen so that the entire width of each of the cutter bits is engaged, and so that the adjacent paths of such cutter bits — as shown in FIG. 3 — will not overlap.

It will be seen that the cutter bit faces 9 will be positioned approximately normal to the direction of the resultant R(see FIG. 3) of the velocity component $V_r$ imparted to the free ends of the cutter bits by the rotation of the mining head in the direction r, and the advance velocity component $V_A$ imparted to the rotary mining head due to the velocity component of the head in the direction A.

While the invention has been herein shown and described in what is presently conceived to be the most practical and preferred embodiment, it will be apparent to one of ordinary skill in the art that many modifications may be made thereof within the scope of the invention, which scope is to be accorded the broadest interpretation of the appended claims so as to encompass all equivalent devices and methods.

What is claimed is:

1. In a mining machine having a jib arm, a rotary mining head (15) mounted on said jib arm for rotation about an axis of rotation (Y), means for rotating said rotary mining head about said axis of rotation, and means for advancing said jib arm in a swivelling movement in a direction (A) along said axis of rotation, said rotary mining head comprising:

a. a body portion (1), b. a plurality of cutter bits (3) carried by said body portion and extending generally radially from said body and each having a free end, each of said cutter bits having an angle of inclination ($\alpha$) with respect to said body, c. a plurality of groups of cutter bits, each group composed of a plurality of cutter bits, (41–45, 46–50, 51–55) each group being spaced along the axis of rotation (Y) of said cutter bits from the other groups, and the free ends of the cutter bits of each of said groups defining a circle, the circles defined by the free ends of the cutter bits of said groups increasing in diameter (Q, R, S) in the axial direction towards attachment of said body to the jib arm, d. said cutter bits groups and said cutter bits within said groups being arranged so that the relationship $a = \tan \alpha \cdot \gamma$ is fulfilled, wherein $a$ = the measured axial distance between two adjacent groups, $\alpha$ = the angle of inclination of each of the cutter bits the ends of which are situated on the circle of larger diameter of the adjacent groups, and $\gamma$ = the length of the arc described by the free end of each of the cutter bits over the angle ($\beta$) by which each of said cutter bits lags behind the cutter bit of the previous group the path of which it enters, and e. each of said cutter bits having a cutting face (9), said cutting faces being positioned substantially normal to the direction of the resultant (R) of (i) the velocity component ($V_r$) imparted to the free ends of the cutter bits by rotation of the mining head in the direction of rotation, ($r$), and (ii) of the advance velocity component ($V_A$) imparted to the rotary mining head due to the velocity component of the head in the direction (A) of said axis of rotation.

2. A rotary mining head as recited in claim 1 wherein the product of (i) the width of said cutting faces of said cutter bits of each group, and (ii) the number of cutter bits of said group, does not exceed the extent of swivel movement imparted to the jib arm during one revolution of said rotary mining head.

3. A rotary mining head as recited in claim 1 wherein the product of (i) the width of said cutting faces of said cutter bits of each group and (ii) the number of said cutter bits of said group, is smaller than the extent of the advancing movement imparted to said rotary mining head during one revolution thereof.

4. A rotary mining head as recited in claim 1 wherein the cutter bits on said rotary mining head are further arranged so that the difference of the diameters of the circles defined by the free ends of the cutter bits of said different groups, and corresponding to the desired predetermined depth of penetration of the head into material which it is to penetrate, is chosen so that at the predetermined depth of penetration the volumes detached by the cutters bits of each of said groups are approximately equal.

* * * * *